US007065832B2

(12) United States Patent
Pohl

(10) Patent No.: US 7,065,832 B2
(45) Date of Patent: Jun. 27, 2006

(54) UPPER HINGE ASSEMBLY FOR REFRIGERATOR DOOR

(75) Inventor: Douglas A. Pohl, Davenport, IA (US)

(73) Assignee: Maytag Corporation, Newton, IA (US)

( * ) Notice: Subject to any disclaimer, the term of this patent is extended or adjusted under 35 U.S.C. 154(b) by 50 days.

(21) Appl. No.: 10/446,680

(22) Filed: May 29, 2003

(65) Prior Publication Data

US 2004/0237257 A1 Dec. 2, 2004

(51) Int. Cl.
*E05D 1/00* (2006.01)

(52) U.S. Cl. ..... 16/235; 16/221

(58) Field of Classification Search ..... 16/221, 16/241, 235–238, 240, 297, 362, 382, DIG. 40, 16/DIG. 43, 247; 312/401, 405.1, 249.7, 312/321.5, 293.2; 403/62, 59, 61, 68, 70, 403/71; 53/416, 421, 478
See application file for complete search history.

(56) References Cited

U.S. PATENT DOCUMENTS

| | | | | |
|---|---|---|---|---|
| 1,067,114 | A * | 7/1913 | Hixson | 16/247 |
| 2,154,716 | A * | 4/1939 | Anderson | 16/247 |
| 3,263,368 | A * | 8/1966 | Hildum et al. | 49/382 |
| 3,290,109 | A | 12/1966 | Vanegas | |
| 3,389,424 | A * | 6/1968 | Fellwock | 16/392 |
| 3,675,271 | A | 7/1972 | Fellwock et al. | |
| 4,416,086 | A * | 11/1983 | Niekrasz | 49/388 |
| 5,265,954 | A * | 11/1993 | Keil | 312/405 |
| 5,272,789 | A * | 12/1993 | Mitchell et al. | 16/291 |
| 5,500,983 | A * | 3/1996 | Lautenschlager | 16/304 |
| 5,666,764 | A | 9/1997 | Beatty et al. | |
| D396,402 | S | 7/1998 | Rastovski | |
| 5,788,351 | A * | 8/1998 | Prunty et al. | 312/326 |
| 5,870,801 | A | 2/1999 | Kim | |
| 5,884,366 | A | 3/1999 | Jeong | |
| 5,960,518 | A | 10/1999 | Jeong | |
| 5,992,028 | A | 11/1999 | Wing | |
| 6,070,300 | A | 6/2000 | Shin et al. | |
| 6,085,385 | A | 7/2000 | Joo | |
| 6,128,807 | A | 10/2000 | Lim et al. | |
| 6,374,458 | B1 * | 4/2002 | Finkelstein | 16/235 |
| 6,375,291 | B1 * | 4/2002 | Nam et al. | 312/405 |
| 6,457,278 | B1 * | 10/2002 | Fleming | 52/37 |
| 6,560,820 | B1 * | 5/2003 | Heisig et al. | 16/243 |
| 6,708,374 | B1 * | 3/2004 | Mandel | 16/436 |

FOREIGN PATENT DOCUMENTS

| | | |
|---|---|---|
| JP | 4-128485 | 4/1992 |

* cited by examiner

*Primary Examiner*—Robert J. Sandy
*Assistant Examiner*—Andre' L. Jackson
(74) *Attorney, Agent, or Firm*—Diederiks & Whitelaw, PLC

(57) ABSTRACT

An upper hinge assembly for pivotally mounting a door to a refrigerator cabinet includes an aligning plate fixedly secured atop a hinge plate to the cabinet. Once the hinge and aligning plates are factory set in position, with tight tolerances between fasteners and holes in the aligning plate, the aligning plate is separately fixed to the hinge plate. The hinge plate can be subsequently detached from the cabinet, with the aligning plate remaining affixed to the hinge plate, and then reattached in a manner which enables the desired factory preset position to be reestablished, thereby assuring that a seal between the door and the cabinet can be effectively maintained.

20 Claims, 2 Drawing Sheets

UPPER HINGE ASSEMBLY FOR REFRIGERATOR DOOR

BACKGROUND OF THE INVENTION

1. Field of the Invention

The present invention pertains to the art of refrigerator cabinets wherein access to an interior of the cabinet is provided by opening a pivotally mounted refrigerator door and, more particularly, to an upper hinge assembly, used to mount the door for pivotal movement, which enables the door to be reinstalled in a precise factory set position following post-manufacturing detachment from the cabinet.

2. Discussion of the Prior Art

In the art of refrigerators, it is customary to enable access to a refrigerated compartment defined within a cabinet by pivotally mounting a respective door for movement between opened and closed positions. Regardless of the particular door configuration of the refrigerator, there is invariably provided at least one upper hinge for rotatably supporting a compartment door to the cabinet. In a typical refrigerator cabinet arrangement, an upper hinge is provided that includes a first portion fixed to a top wall or panel of the cabinet, such as through the use of various threaded fasteners, and a second, hinge axis defining portion which establishes a pivot axis for the door.

When a refrigerator cabinet of this type is initially assembled at a factory, extreme care is taken to assure the precise mounting location for the upper hinge. More specifically, both upper and lower hinges for the door must be properly positioned in order to assure that a gasket provided about a peripheral portion of the door will establish a proper seal with the cabinet upon closing the door. Any misalignment can result in that seal being broken, thereby resulting in a considerable loss of refrigeration and overall product efficiency.

Unfortunately, although a refrigerator door may be properly mounted relative to the cabinet at the factory, various occurrences can actually alter the particular mounting, thereby creating a misalignment between the door and the cabinet. For instance, care must be taken during loading, unloading, and shipping of the refrigerator to avoid the development of misalignment problems. In general, these concerns are considered to have been adequately addressed with appropriate packaging and handling techniques. However, it is sometimes necessary for service personnel to remove a door of a refrigerator. In addition, the installation of a refrigerator may require the door to be detached from the cabinet in order to enable the overall refrigerator to clear predefined doorways. Under at least these circumstances, it is necessary to remove one or more of the hinges. Typically, the upper hinge is disconnected from the cabinet. In any case, whenever the upper hinge is removed, it is near impossible to re-establish the original mounting with precision. Therefore, some misalignment is almost invariably created when reinstalling the door relative to the cabinet.

With this in mind, there have been attempts to address these concerns. For instance, U.S. Pat. No. 5,992,028 discloses an arrangement for positively aligning a door on a refrigerator cabinet wherein one or more alignment projections are fixed to a top surface of the cabinet, either directly or through the use of a plate. An upper hinge for the door is initially orientated relative to the cabinet by having each projection extend through a respective hole formed in the upper hinge. Screws are then employed, at positions spaced from each projection, to secure the upper hinge to the top surface of the cabinet. If the door needs to be removed, the upper hinge can be detached from the cabinet. However, the projection structure remains fixed to the top surface of the cabinet, thereby enabling the upper hinge to be reinstalled in the factory set position.

Although this patented arrangement describes an upper hinge mounting assembly which addresses certain concerns of the present invention, there still exists a need in the art of refrigerators for an upper hinge assembly which enables a door of a refrigerator cabinet to be efficiently and effectively detached and reattached, while assuring that a factory preset mounting relationship between the door and cabinet can be precisely re-established in order to maintain a proper seal. Moreover, there exists a need for an upper hinge assembly which can perform this function while being simply in construction, economically feasible to implement, and effective over a long period of time.

SUMMARY OF THE INVENTION

The present invention is directed to an upper hinge assembly for pivotally mounting a door to a refrigerator cabinet in a manner which assures that the door can be detached from the cabinet, thereby voiding a factory setting, and yet be reattached to the exact factory setting. In this manner, the necessary, relative positioning between the door and the cabinet which enables proper peripheral sealing of the door is assured.

In accordance with the invention, the upper hinge assembly includes a hinge plate and an aligning plate. During manufacturing of the overall refrigerator cabinet, the aligning plate is arranged atop the hinge plate and fixedly secured to the top panel surface of the cabinet in unison with the hinge plate through the use of mechanical fasteners extending through coaxial holes in the aligning and hinge plates. Preferably, the fasteners are actually received in a reinforcing plate secured below the top panel of the cabinet. Thereafter, the aligning plate is fixedly secured atop the hinge plate, preferably through an additional mechanical fastener which only extends into the hinge plate and not the cabinet. Most preferably, the aligning plate is provided with a slot which receives a small mechanical fastener that maintains the aligning plate in an established orientation relative to the hinge plate.

With this construction, both the aligning plate and the hinge plate can be simultaneously fixed to the cabinet in a required, proper seal establishing position at the factory. An additional mechanical fastener is also preferably employed to further connect at least the hinge plate to the cabinet. Thereafter, the aligning plate is fixed directly to the hinge plate. If it becomes necessary to later remove the hinge plate, the aligning plate will still remained fixed to the hinge plate. Although the size of the holes formed in the hinge plate would permit some relative shifting between the hinge plate and the cabinet upon remounting, the holes in the aligning plate are sized to receive the main mechanical fasteners with a tight tolerance such that the fixed position of the aligning plate upon the hinge plate assures the factory established position can be readily reestablished. Therefore, if the hinge plate must be detached to temporarily remove the door for transportation, service, or other purposes, the aligning plate stays fixed to the hinge plate to assure proper remounting of the hinge plate and, correspondingly, proper remounting of the door relative to the cabinet in a single, consistent position so as to reestablish the appropriate seal.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
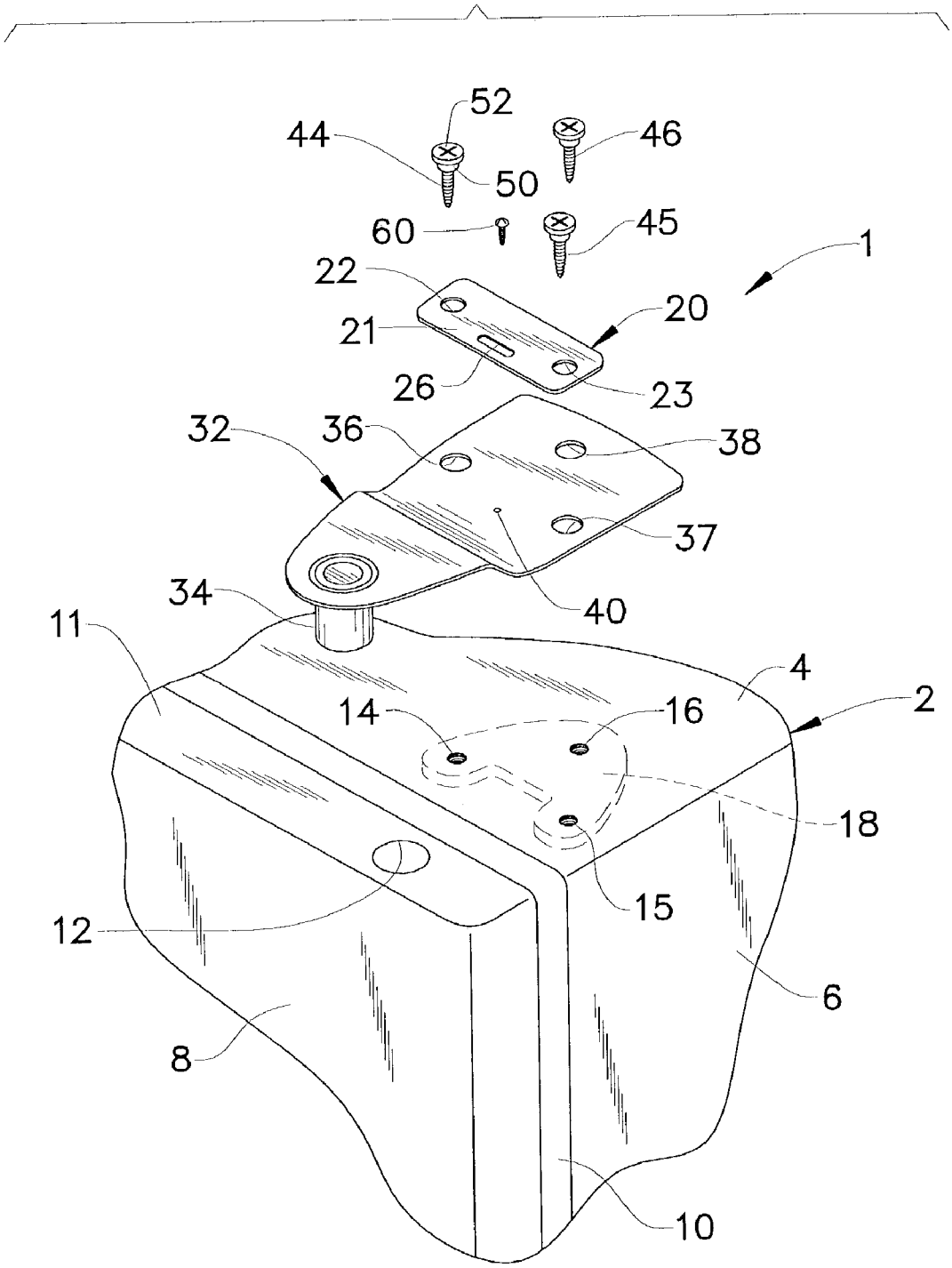
FIG. 1 is a perspective view of a top portion of a refrigerator cabinet showing the upper door hinge assembly of the invention in an exploded view.

With initial reference to FIG. 1, an upper hinge assembly constructed in accordance with the preferred embodiment of the invention is generally indicated at 1. In the embodiment shown, upper hinge assembly 1 is applied to a top mount refrigerator cabinet 2. However, at this point, it should be noted that upper hinge assembly 1 is equally applicable for use in connection with other types of refrigerators, including side-by-side and bottom mount style refrigerators. In any event, the partial view of refrigerator cabinet 2 illustrates a top wall 4, one sidewall 6, and a door 8. An annular seal or gasket 10 is provided about an inner periphery of door 8 and is adapted to engage a front face (not labeled) of cabinet 2 in order to seal a refrigerator compartment access opening in a manner widely known in the art. Also, door 8 includes an upper edge portion 11 provided with a receiving bore 12.

As illustrated in the exploded view of FIG. 1, top wall 4 is provided with three, generally triangularly arranged holes 14–16 for use in securing upper hinge assembly 1 to top wall 4 of refrigerator cabinet 2. More specifically, a reinforcing plate 18 is preferably secured beneath top wall 4 in order to act as a structural reinforcement for upper hinge assembly 1, with reinforcing plate 18 having holes aligned with holes 14–16. Upper hinge assembly 1 includes an aligning plate 20 having an upper surface 21 and a pair of spaced, preferably circular holes 22 and 23. Aligning plate 20 is also provided with a dedicated fastener receiving hole 26 which preferably takes the form of a substantially transversely extending slot. In the most preferred form of the invention, holes 22, 23 and 26 are spaced apart from one another and arranged in a generally triangular pattern, with holes 22 and 23 being alignable with holes 14 and 15 in top wall 4.

Upper hinge assembly 1 also includes a hinge plate 32 provided with a pivot pin 34. In a manner known in the art, pivot pin 34 can be formed as a separate piece and welded in place or drawn as an integral part of the remainder of hinge plate 32. In either case, pin 34 is sized to extend into bore 12 of door 8 so as to define a rotational axis for the opening and closing of door 8. Hinge plate 32 is provided with fastener receiving apertures 36–38. Fastener receiving apertures 36–38 are spaced apart and arranged in a generally triangular fashion corresponding to holes 14–16 respectively. An additional mounting aperture 40 is also provided in hinge plate 32. As shown in the preferred embodiment depicted, mounting aperture 40 is preferably much smaller than apertures 36–38.

When hinge assembly 1 is being factory mounted to cabinet 2, the manufacturer determines the mounting position needed for hinge plate 32 in order to properly orientate hinge plate 32, and thus pin 34, so that door 8 will be positioned on cabinet 2 in a manner which assures a complete seal through gasket 10. Once the proper position is achieved, mounting fasteners 44–46 are utilized to fixedly secure hinge plate 32, as well as aligning plate 20, into reinforcing plate 18 through hole 22 and aperture 36, hole 23 and aperture 37, and aperture 38 respectively. At this point, it should be recognized that the tolerances associated with apertures 36–38 in hinge plate 32 and fasteners 44–46 would not enable hinge plate 32 to be removed from cabinet 2 and later replaced in the same, proper sealing position. If such a tight tolerance was established, there would be no room for any initial adjustment between hinge plate 32 and cabinet 2 at the factory. However, in accordance with the invention, each of fasteners 44 and 45 are specifically configured to have a short shank portion 50 directly adjacent a head 52. Shank portion 50 has an associated diameter which is tightly toleranced to a respective hole 22, 23 in aligning plate 20. Therefore, although each shank portion 50 is smaller than the diameter associated with each aperture 36, 37, there is no room for alignment plate to shift relative to cabinet 2 once fasteners 44 and 45 are tightened. In this manner, hinge plate 32 can be adjusted relative to cabinet 4, with hinge plate 32 also being able to initially shift relative to aligning plate 20.

Figure 2:
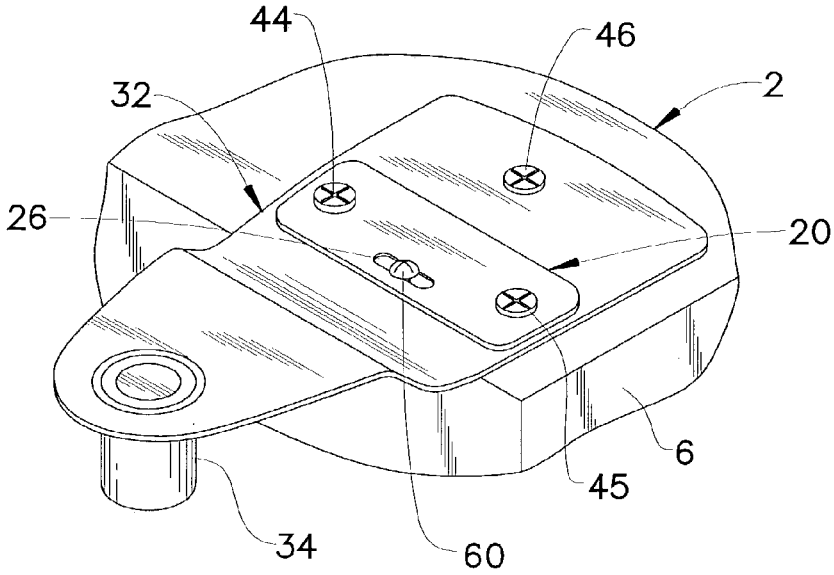
FIG. 2 is a perspective view of the upper hinge assembly of the invention in a filly assembled state.

Once the desired positioning of hinge plate 32 is achieved, fasteners 44–46 can be tightened to prevent any shifting between aligning plate 20, hinge plate 32 and cabinet 2. Thereafter, a dedicated mounting fastener 60 is used to fixedly secure aligning plate 20 upon hinge plate 32 at slot 26 and mounting aperture 40. Of course, the existence of slot 26 enables the necessary relative positioning between aligning plate 20 and hinge plate 32 as indicated above. At this point, hinge assembly 1 assumes the position shown in FIG. 2 which is preferably the condition hinge assembly 1 takes upon completion of the manufacturing process.

In accordance with the invention, each of fasteners 44–46 and 60 is preferably constituted by a screw, however, other known mechanical fasteners could be employed. At this point, it should be noted that only one mounting fastener 60 has been found necessary in securely fixing aligning plate 20 to hinge plate 32. In any event, it is within the scope of the invention to provide additional mounting structure which can establish another mounting point if desired, such as another hole and fastener combination.

Figure 3:
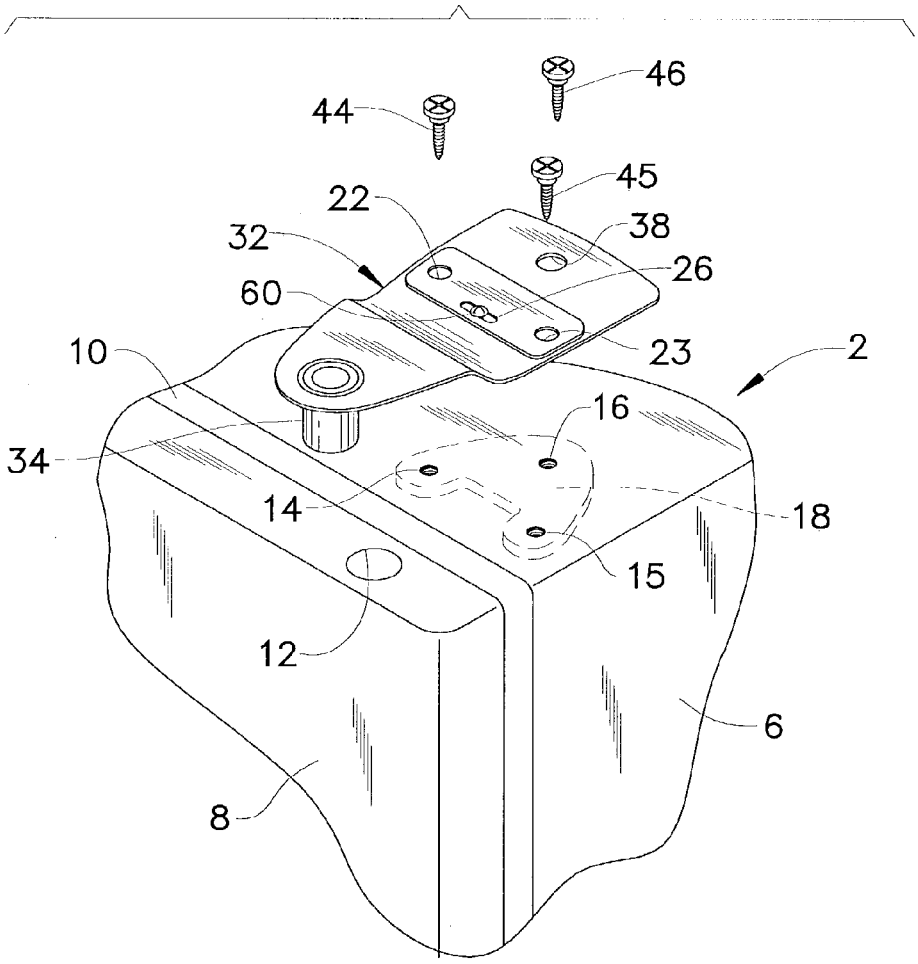
FIG. 3 is a perspective view of the upper hinge assembly shown subsequently detached from the refrigerator cabinet.

Once both aligning plate 20 and hinge plate 32 are fixed to cabinet 2, as well as each other, in the manner set forth above, hinge plate 32 can be subsequently removed or detached from cabinet 2 by removing fasteners 44–46. However, aligning plate 20 remains fixed to hinge plate 32 as represented in FIG. 3. Since shank portions 50 are tightly received in holes 22 and 23 of aligning plate 20, hinge plate 32 can only be positioned back upon cabinet 4 in a single, predetermined position, thereby assuring a proper alignment between door 8 and cabinet 2 for effective sealing purposes.

In accordance with the invention, both aligning plate 20 and hinge plate 32 are preferably made of metal, although other materials could be employed. Although the specific dimensions and the like can change, in the most preferred form of the invention, hinge plate 32 is approximately 3 mm thick, aligning plate 20 is approximately 1.5 mm thick, each aperture 36, 37 has a diameter in the order of 9 mm, each hole 22, 23 has a diameter in the order of 7 mm, and mounting hole 26 has a width of about 2–4 mm.

Although described with reference to a preferred embodiment of the invention, it should be readily understood that various changes and/or modifications can be made to the invention without departing from the spirit thereof. For instance, although fasteners 44–46 and 60 are constituted by screws in accordance with the most preferred embodiment of the invention, other types of fastening arrangements could be employed, particularly other known types of mechanical fasteners. In addition, the particular manner in which aligning plate 20 is fixedly secured to hinge plate 32 could also vary while still performing the same function. In any event, the invention is only intended to be limited by the scope of the following claims.

I claim:

1. An upper refrigerator hinge assembly for pivotally mounting a door to a refrigerator cabinet, said hinge assembly comprising:

an aligning plate provided with at least first and second holes;

a hinge plate provided with at least first and second apertures;

a first fastener fixedly securing both the hinge plate and the aligning plate to a cabinet, with said aligning plate being located upon said hinge plate and the first fastener extending through each of the first hole and the first aperture; and a second fastener for attaching the aligning plate to the hinge plate, with the second fastener extending through each of the second hole and the second aperture wherein, upon subsequent detachment of the hinge plate from the cabinet, the aligning plate remains fixed upon the hinge plate in order to enable proper orientation of the hinge plate relative to the cabinet during reattachment.

2. The hinge assembly according to claim 1, further comprising:

a third aperture provided in the hinge plate; and a third fastener, said third fastener extending into the third aperture and directly attaching the hinge plate to the cabinet.

3. The hinge assembly according to claim 1, wherein the second hole constitutes a slot.

4. The hinge assembly according to claim 3, wherein the slot extends substantially transverse relative to the cabinet.

5. The hinge assembly according to claim 1, wherein the first hole has a diameter which is smaller than a diameter of the first aperture.

6. The hinge assembly according to claim 5, wherein the first fastener includes a shank portion adjacent a head portion, said shank portion being received in the first hole with a tight tolerance.

7. The hinge assembly according to claim 1, further comprising:

third and fourth apertures formed in the hinge plate;

a third hole formed in the aligning plate;

a third fastener extending through the third hole and the third aperture for securing both the aligning plate and the hinge plate to the cabinet; and a fourth fastener extending through the fourth aperture for directly securing the hinge plate to the cabinet.

8. In a refrigerator cabinet including an upper hinge assembly for pivotally mounting a door to an outer exterior top surface of the cabinet, said upper hinge assembly comprising:

an aligning plate; and a hinge plate, wherein both the hinge plate and the aligning plate are secured to the outer exterior top surface of the cabinet, and wherein said aligning plate is separately, fixedly secured atop and directly to the hinge plate such that, upon detachment of the hinge plate from the cabinet, the aligning plate remains fixed upon the hinge plate in order to enable proper orientation of the hinge plate relative to the cabinet during reattachment.

9. The upper hinge assembly according to claim 8, wherein the hinge plate is made of metal and the aligning plate is made of metal.

10. The upper hinge assembly according to claim 8, further comprising:

first and second apertures provided in the hinge plate;

first and second holes formed in the aligning plate; and first, second and third fasteners, wherein said first fastener extends through both the first hole and the first aperture to secure both the aligning plate and the hinge plate to the cabinet, said second fastener extends through both the second hole and the second aperture to also secure both the aligning plate and the hinge plate to the cabinet, and said third fastener extends through the aligning plate and into the hinge plate to fixedly secure the aligning plate atop the hinge plate.

11. The upper hinge assembly according to claim 10, wherein the third fastener is smaller than each of the first and second fasteners.

12. The upper hinge assembly according to claim 10, further comprising: a third hole formed in the aligning plate, wherein said third fastener extends through the third hole and into the hinge plate.

13. The upper hinge assembly according to claim 12, wherein the third hole constitutes a slot.

14. The upper hinge assembly according to claim 13, wherein the slot extends substantially transverse relative to the cabinet.

15. The upper hinge assembly according to claim 10, wherein each of the first and second holes has a diameter which is smaller than a diameter of each of the first and second apertures.

16. The upper hinge assembly according to claim 15, wherein each of the first and second fasteners includes a shank portion adjacent a head portion, said shank portion fitting into a respective one of the first and second holes with a tight tolerance.

17. A method of mounting an upper refrigerator door hinge assembly to a refrigerator cabinet comprising:

positioning an aligning plate atop a hinge plate;

securing both the aligning plate and the hinge plate in a desired location and orientation to an outer exterior a top surface of the refrigerator cabinet; and separately, fixedly securing the aligning plate to the hinge plate in order to set the desired location and orientation of the hinge plate relative to the cabinet.

18. The method of claim 17, further comprising:

detaching the hinge assembly from the cabinet with the aligning plate remaining fixed to the hinge plate; and simultaneously reattaching the aligning plate and the hinge plate to the cabinet.

19. The method of claim 17, wherein the aligning plate is fixedly secured to the hinge plate by a fastener extending through a slot formed in the aligning plate.

20. The method of claim 17, wherein the aligning plate and hinge plate are secured to the cabinet by multiple mechanical fasteners each having a shank portion adjacent a head portion, with the shank portion fitting into a respective hole formed in the aligning plate with a tight tolerance.

* * * * *